US007568527B2

(12) United States Patent
Richter et al.

(10) Patent No.: US 7,568,527 B2
(45) **Date of Patent: *Aug. 4, 2009**

(54) METHOD OF COLLECTING CRUDE OIL AND CRUDE OIL COLLECTION HEADER APPARATUS

(75) Inventors: Jonathan Richter, Sheridan, WY (US); John McCarthy, Sheridan, WY (US)

(73) Assignee: Rock Well Petroleum, Inc., Sheridan, WY (US)

( * ) Notice: Subject to any disclaimer, the term of this patent is extended or adjusted under 35 U.S.C. 154(b) by 189 days.

This patent is subject to a terminal disclaimer.

(21) Appl. No.: 11/649,483

(22) Filed: Jan. 4, 2007

(65) Prior Publication Data

US 2008/0164020 A1 Jul. 10, 2008

(51) Int. Cl.
*E21B 43/16* (2006.01)
*E21B 43/12* (2006.01)

(52) U.S. Cl. ..... 166/369; 166/75.12; 166/75.13; 166/97.1; 166/316; 166/373

(58) Field of Classification Search ..... None
See application file for complete search history.

(56) References Cited

U.S. PATENT DOCUMENTS

| | | | |
|---|---|---|---|
| 1,634,235 | A | 6/1927 | Ranney |
| 1,634,236 | A | 6/1927 | Ranney |
| 1,660,818 | A | 2/1928 | Ranney |
| 1,667,269 | A | 4/1928 | Ranney |
| 1,722,679 | A | 7/1929 | Ranney |
| 1,811,560 | A | 6/1931 | Ranney |
| 1,811,561 | A | 6/1931 | Ranney |
| 1,812,305 | A | 6/1931 | Ranney |
| 1,842,098 | A | 1/1932 | Howard |
| 1,851,446 | A | 3/1932 | Ranney |
| 1,858,847 | A | 5/1932 | Young |
| 1,877,915 | A | 9/1932 | Lewis |
| 1,884,858 | A | 10/1932 | Ranney |
| 1,935,643 | A | 11/1933 | Laughlin |
| 2,331,072 | A | 10/1943 | Hansen et al. |

(Continued)

FOREIGN PATENT DOCUMENTS

| | | |
|---|---|---|
| WO | WO 2006/135744 | 12/2006 |

(Continued)

OTHER PUBLICATIONS

Bartis et al., "Oil Shale Development in the United States", RAND Infrastructure, Safety, and Environment, pp. 1-61, 2005.

(Continued)

*Primary Examiner*—Zakiya W. Bates

(57) ABSTRACT

The invention includes methods of collecting crude oil and apparatus which collect crude oil. In one implementation, a crude oil collection header apparatus comprises a collection reservoir. A plurality of fluid conduits is connected to feed crude oil to the collection reservoir. The fluid conduits respectively comprise a collection reservoir feed valve, a bypass valve, and a crude oil feed inlet received between the collection reservoir feed and bypass valves. A flow meter conduit is connected with multiple of the plurality of fluid conduits downstream of the respective bypass valves. A flow meter is operably connected with the flow meter conduit. A crude oil outlet is associated with the collection reservoir. Other aspects and implementations are disclosed.

35 Claims, 3 Drawing Sheets

U.S. PATENT DOCUMENTS

| | | | | |
|---|---|---|---|---|
| 2,850,271 | A | 9/1958 | Dykstra | |
| 2,989,294 | A | 6/1961 | Coker | |
| 3,749,170 | A | 7/1973 | Riehl | |
| 3,785,402 | A * | 1/1974 | Collier | 137/561 A |
| 3,820,605 | A | 6/1974 | Barber et al. | |
| 3,866,697 | A | 2/1975 | Rossfelder et al. | |
| 3,934,935 | A | 1/1976 | Lambley et al. | |
| 4,047,760 | A | 9/1977 | Ridley | |
| 4,061,190 | A | 12/1977 | Bloomfield | |
| 4,101,172 | A | 7/1978 | Rabbitts | |
| 4,140,180 | A | 2/1979 | Bridges et al. | |
| 4,144,935 | A | 3/1979 | Bridges et al. | |
| 4,165,903 | A | 8/1979 | Cobbs | |
| 4,283,088 | A | 8/1981 | Tabakov et al. | |
| 4,378,949 | A | 4/1983 | Miller | |
| 4,381,124 | A | 4/1983 | Verty et al. | |
| 4,401,163 | A | 8/1983 | Elkins | |
| 4,423,907 | A | 1/1984 | Ridley | |
| 4,441,759 | A | 4/1984 | Hutchins et al. | |
| 4,444,433 | A | 4/1984 | Ricketts | |
| 4,458,757 | A | 7/1984 | Bock et al. | |
| 4,458,945 | A | 7/1984 | Ayler et al. | |
| 4,463,987 | A | 8/1984 | Berg et al. | |
| 4,483,398 | A | 11/1984 | Peters et al. | |
| 4,508,168 | A | 4/1985 | Heeren | |
| 4,524,826 | A | 6/1985 | Savage | |
| 4,595,239 | A | 6/1986 | Ayler et al. | |
| 4,607,888 | A | 8/1986 | Trent et al. | |
| 4,693,313 | A | 9/1987 | Stephenson et al. | |
| 4,811,741 | A | 3/1989 | Shell et al. | |
| 5,040,601 | A | 8/1991 | Karlsson et al. | |
| 5,082,054 | A | 1/1992 | Kiamanesh | |
| 5,082,056 | A | 1/1992 | Tackett, Jr. | |
| 5,547,021 | A | 8/1996 | Raden | |
| 6,001,333 | A | 12/1999 | See | |
| 6,149,345 | A | 11/2000 | Atkins | |
| 6,561,041 | B1 * | 5/2003 | Eck | 73/861.04 |
| 7,093,661 | B2 * | 8/2006 | Olsen | 166/357 |
| 2006/0290197 | A1 | 12/2006 | See et al. | |
| 2007/0012450 | A1 | 1/2007 | Uttley | |

FOREIGN PATENT DOCUMENTS

WO WO 2007/025698 5/2008

OTHER PUBLICATIONS

D.A. Best et al., *Underground Test Facility: Shaft and Tunnel Laboratory for Horizontal Well Technology,* 60th Annual Tech. Conf./Exhibition, Soc. of Petroleum Engineers, Las Vegas, NV, SPE 14333, 16 pp. (Sep. 22-25, 1985).

R.A. Dick et al., *Oil Mining,* pp. 182-186 (pre-Jul. 2006).

H.G. Stephenson et al., *Underground mining and tunneling techniques for in-situ oil recovery,* Tunnels and Tunnelling, pp. 41-45 (1988).

W.S. Streeter, et al., *Recovery of Oil From Underground Drillsites,* SPE Eastern Regional Meeting of the Society of Petroleum Engineers, Morgantown, West Virginia, SPE 19344, pp. 339-348 (Oct. 24-29, 1998).

U.S. Appl. No. 11/652,908, filed Jan. 11, 2007, Richter et al.

Cowan, 1928-1985: *The Devran Gravity Assisted Drainage of Petroleum Project,* Geology-Devonian, vol. 24, No. 12, Ontario Petroleum Institute Conference and Trade Show, pp. 1-7 (1986).

Lyman et al., *Heavy Oil Mining Technical and Economic Analysis,* Society of Petroleum Engineers, California Regional Meeting, SPE 12788, pp. 565-574 (Long Beach, CA Apr. 11-13, 1984).

Ranney, *Horizontal Wells Are All in Pay—and Flow by Gravity,* The Petroleum Engineer, pp. 127-130 (Aug. 1941).

Rice, *Mining Petroleum by Underground Methods: A Study of Methods Used in France and Germany and Possible . . . ,* U.S. Department of Commerce, Bureau of Mines, Bulletin 351, pp. Title1—159 (1932).

Publication of TAM International, *Horizontal Jet Pump Testing With Jet Pump in Lateral,* http://www.tamintl.com/pages/tech3j.htm, 1 page (May 13, 2005).

Publication of TAM International, *Locating and Controlling Water Production in Horizontal Wells* (*Permian, Base* ), http://www.tamintl.com/pages/tech3.htm, 5 pages (Oct. 27, 2006).

Publication of TAM International, *McElroy Field Horizontal Well Case History No. 1,* Crier McElroy 147, Fluid Entry Evaluation and Water Shut-off, http://www.tamintl.com/pages/tech3c.htm, 1 page (Oct. 27, 2006).

Publication of TAM International, *McElroy Field Typical Horizontal Well Application,* Figure 1, http://www.tamintl.com/pages/tech3b.htm, 1 page (Sep. 15, 2006).

Publication of TAM International, *Scab Liner and Bridge Plug,* http://www.tamintl.com/pages/tech3j.htm, 1 page (May 13, 2005).

U.S. Appl. No. 11/652,939, filed Jan. 11, 2007, Richter et al.

See, Mark, "Oil mining field test to start in East Texas", Gulf Publishing Company, 1996, reprinted from the Nov. 1996 issue of World Oil Magazine.

* cited by examiner

METHOD OF COLLECTING CRUDE OIL AND CRUDE OIL COLLECTION HEADER APPARATUS

TECHNICAL FIELD

This invention relates to methods of collecting crude oil and to apparatus which collect crude oil.

BACKGROUND OF THE INVENTION

The production of oil and depletion of a reservoir is typically not achieved by the natural energy of the reservoir alone (primary recovery). With primary recovery methods, oil may be produced as long as there is sufficient reservoir pressure to create flow into a well bore. Primary methods include the natural drive due to formation pressure and/or artificial lift accomplished by either pumps or lifting methods. Secondary recovery methods involve primary methods plus the addition of energy to the reservoir, typically in the form of forced injection of gas or liquid to replace produced fluids and maintain or increase reservoir pressure. Primary methods might only enable depletion of from 10% to 17% of an oil reservoir. Secondary methods typically can increase this amount to from 20% to 35%. If primary and secondary methods fail to achieve the desired production results, then tertiary methods might be added if field conditions warrant. Tertiary methods typically employ chemical and/or thermal techniques to lower the viscosity of the remaining oil-in-place and decrease the mobility of water. Yet despite the continued application and improvements of these conventional recovery techniques, in many instances two-thirds or more of known original oil-in-place can remain in the reservoirs.

Oil mining has been proposed to attempt to recover parts of this unrecovered oil that cannot be produced by primary, secondary, and/or tertiary methods. Oil mining techniques employ a combination of petroleum technology and mining technology. By way of example only, existing proposed oil mining techniques include one or a combination of an extraction method, a fracturing method, and/or a drainage method. The extraction method typically involves physical removal of reservoir rock in part or in whole to the surface where oil can be extracted, often by means of heating. A fracturing method typically employs blasting of the formation rock in the underground reservoir to recover oil.

The drainage method is somewhat similar to the conventional method for extracting oil from the surface, except wells are drilled from beneath or laterally from the side into the reservoir by means of mined slots and drift mining. In the drainage method, a cavity is typically provided somewhere beneath crude oil-bearing strata and is typically of a suitable size for workers and equipment to be received therein. A series of wells are then drilled upwardly or laterally into the reservoir for collecting oil by means of gravity. Secondary or tertiary methods as described above may also be utilized in addition to gravity for assisting flow of oil to a location beneath the reservoir. From there, it is pumped to the surface. Needs remain for equipment, systems, and methods for collecting crude oil from beneath an oil reservoir which flows thereto at least in part by the force of gravity.

While the invention was motivated in addressing the above identified issues, it is in no way so limited. The invention is only limited by the accompanying claims as literally worded, without interpretative or other limiting reference to the specification, and in accordance with the doctrine of equivalents.

SUMMARY

The invention includes methods of collecting crude oil, and apparatus which collect crude oil. In one implementation, a crude oil collection header apparatus comprises a collection reservoir. Fluid conduits are connected to feed crude oil to the collection reservoir. The fluid conduits respectively comprise a collection reservoir feed valve, a bypass valve, and a crude oil feed inlet received between the collection reservoir feed and bypass valves. A flow meter conduit is connected with multiple of the plurality of fluid conduits downstream of the respective bypass valves. A flow meter is operably connected with the flow meter conduit. A crude oil outlet is associated with the collection reservoir.

In one implementation, a method of collecting crude oil includes positioning a collection header apparatus within the earth elevationally lower than a crude oil-bearing strata, and wherein the collection header apparatus comprises a collection reservoir. A plurality of well lines in fluid communication with the crude oil-bearing strata is connected to the collection header apparatus. Crude oil is flowed at least in part by gravity from the crude oil-bearing strata through the well lines to the collection reservoir of the collection header apparatus. Crude oil is withdrawn from the collection reservoir. Periodically, the flowing crude oil in individual of the well lines is separately routed through a flow meter to monitor therefrom flow of crude oil in said individual well lines.

Other aspects and implementations are contemplated.

BRIEF DESCRIPTION OF THE DRAWINGS

Preferred embodiments of the invention are described below with reference to the following accompanying drawings.

DETAILED DESCRIPTION OF THE PREFERRED EMBODIMENTS

Aspects of the invention include crude oil collection header apparatus, and methods of collecting crude oil. Apparatus aspects of the invention can be practiced independent of the method aspects, and the method aspects can be practiced independent of the specifically disclosed and preferred various crude oil collection header apparatus aspects. In other words, the method aspects of the invention do not necessarily require use of the disclosed apparatus, and the disclosed apparatus do not necessarily require nor operate according to practice of the claimed methods.

Figure 1:
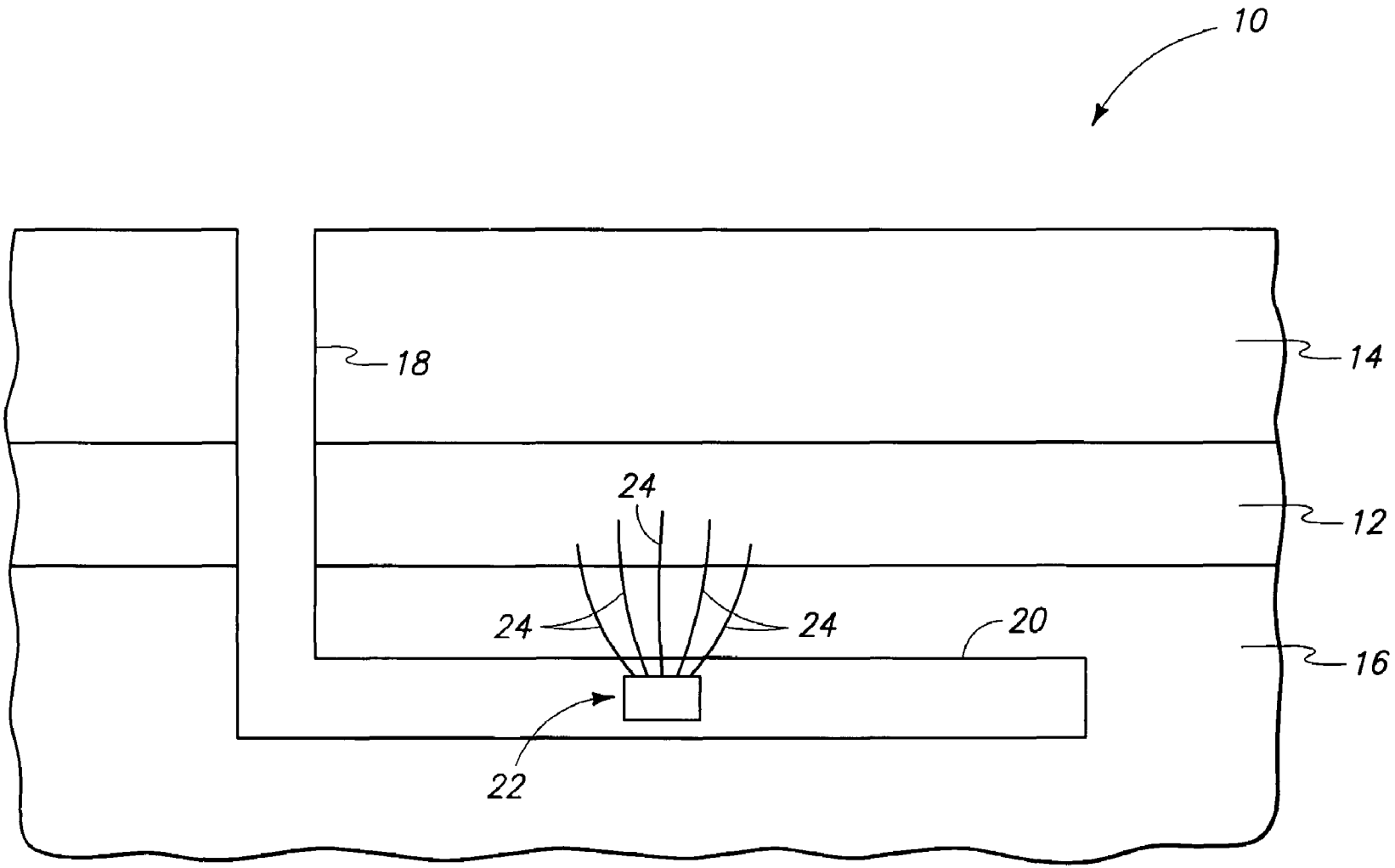
FIG. 1 is a diagrammatic elevational view of an underground crude oil extraction system.
Figure 2:
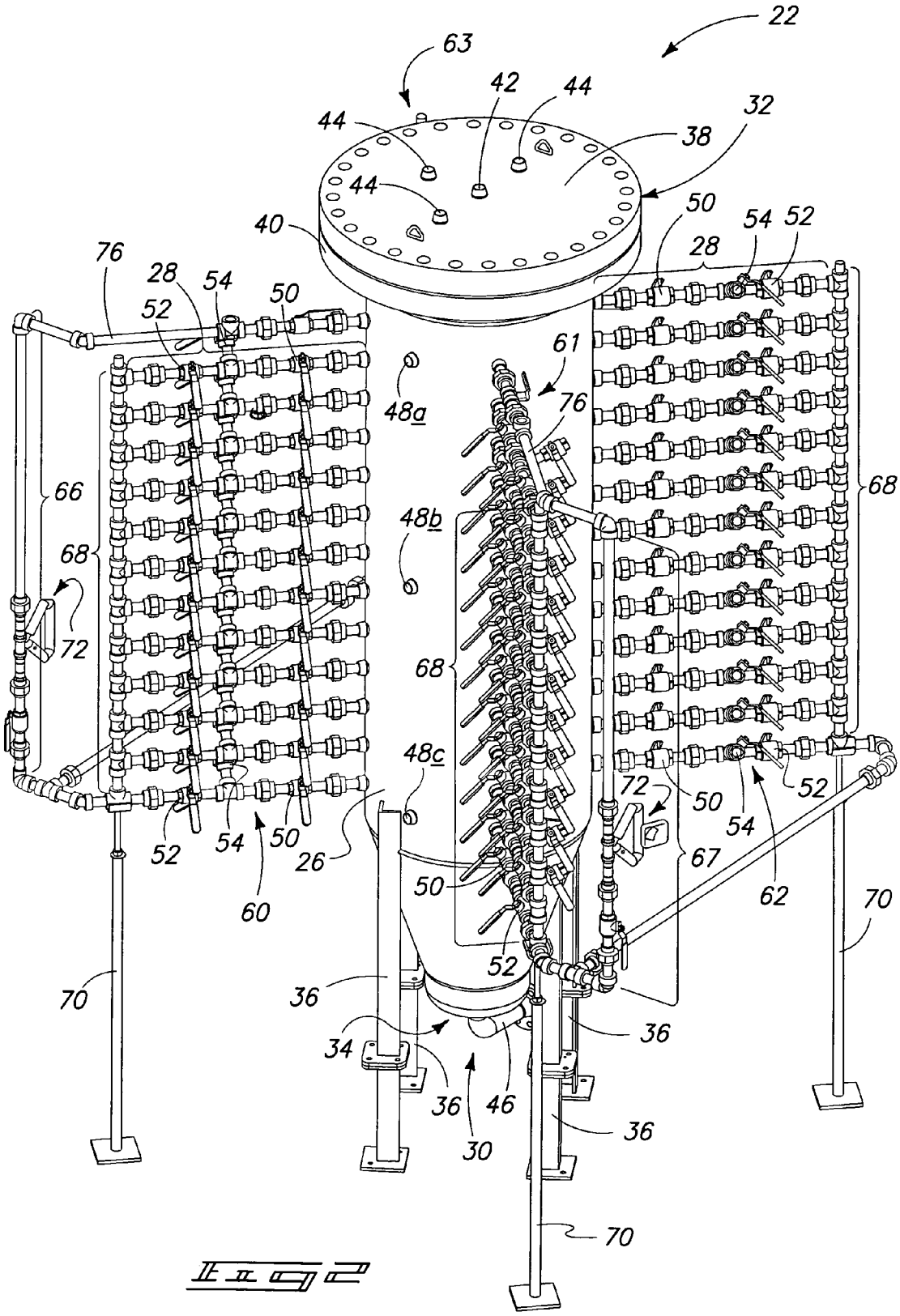
FIG. 2 is a perspective view of a crude oil collection header apparatus in accordance with an aspect of the invention.

Exemplary embodiment crude oil collection header apparatus are described initially with reference to FIGS. 1 and 2. FIG. 1, by way of example only, depicts an exemplary environment or system 10 within which a preferred crude oil collection header apparatus in accordance with the invention might be utilized. Alternate embodiments, including those not necessarily being subterranean, are also of course contemplated, and whether existing or yet-to-be developed. Environment or oil well system 10 comprises some crude oil-bearing strata 12 having earthen regions 14 and 16 above and below, respectively. Strata 12 might comprise any material containing crude oil including by way of example only, a source bed, receiver bed, sandstone, shale or other earthen material within which crude oil is received. Strata 12 might contain gas, water, and/or other liquids or solid material, and be of any porosity and permeability. A main shaft 18 is provided to a greater depth than exemplary crude oil-bearing strata 12, and a drift or other generally laterally extending tunnel 20 is provided therefrom to beneath oil-bearing strata 12. Such might be formed by any existing or yet-to-be developed techniques, with FIG. 1 being diagrammatic only. For example and by way of example only, main shaft 18 and tunnel 20 might be oriented at different angles relative to one another, oil-bearing strata 12, and/or the earth's surface. Further, vent and/or other shafts might also be provided relative to tunnel 20 or primary shaft 18. Further of course, more than one tunnel 20 might be provided from main shaft 18, and/or at different elevations. Further of course, shaft 18 and/or tunnel 20 might of any alternate configurations or orientations.

A crude oil collection header apparatus is provided within drift or tunnel 20, and is indicated generally with reference numeral 22. A plurality of production wells have been drilled upwardly into crude oil-bearing strata 12, with a series of exemplary conduit or well lines 24 shown extending in fluid communication with crude oil-bearing strata 12 to collection header apparatus 22. Multiple collection header apparatus would likely be used for a given reservoir, with only one such apparatus being shown in FIG. 1 for clarity By way of example only, preferred embodiments of a crude oil collection header apparatus are initially described with reference to FIG. 2. FIG. 2 depicts a crude oil collection header apparatus 22 comprising a collection reservoir 26 having a plurality of fluid conduits 28 connected to feed crude oil thereto. Some crude oil outlet 30 is associated with collection reservoir 26. In the depicted preferred embodiment, collection reservoir 26 is elongated and substantially vertically oriented, having an upper end 32 and a lower end 34. Collection reservoir 26 is depicted as being supported in an upright manner by a series of four leg assemblies 36. Upper end 32 is depicted as comprising a lid 38 which bolts to an upper flange 40 of collection reservoir 26. A preferred pressure relief valve outlet 42 is diagrammatically depicted as being associated with lid 38, and one or more gas outlets 44 might also be provided for collecting any gas which separates and builds up within reservoir 26 during collection of fluid which flows to apparatus 22.

Crude oil outlet 30 is depicted as being provided proximate lower end 34, and preferably at the lowest point thereof. In the context of this document, "proximate" with respect to an end of the collection reservoir defines a location which is no greater than within 1 foot of the recited end of the collection reservoir. A suitable crude oil outlet conduit 46 is connected with or to crude oil outlet 30. Alternate configurations of a collection reservoir are also of course contemplated, although an elongated and substantially vertically oriented collection reservoir is preferred that has a crude oil outlet at the bottom end thereof for outflow primarily by gravity. Alternately or in addition thereto, crude oil outlet conduit 46 might connect with a suitable pumping apparatus (not shown) for passing crude oil collected within reservoir 26 to other processing apparatus located within the earth and/or ultimately to pumping to locations above the earth's surface. By way of example only, an overall height of a reduction-to-practice header apparatus 22 is eleven feet.

Collection reservoir 26 might be provided with a plurality of fluid level sensors, such as the depicted three fluid level sensors 48*a*, 48*b*, 48*c*. Upper fluid level sensor 48*a* might be utilized to identify or trigger an upper fluid level alarm point, lower fluid level sensor 48*c* utilized to identify or trigger a lower fluid level alarm point, and middle fluid level sensor 48*b* defining a point where the fluid level transitions from being closer to one of sensors 48*a* and 48*c* to the other of sensors 48*a* and 48*c*.

Fluid conduits 28 respectively comprise a collection reservoir feed valve 50, a bypass valve 52, and a crude oil feed inlet 54 received between (at least in the context of fluid flow) collection reservoir feed valve 50 and bypass valve 52. The collection reservoir feed valves and/or bypass valves might be manually or remotely operated, for example by a hand lever as depicted, electrically, pneumatically, hydraulically, and/or by other means whether existing or yet-to-be developed. Individual well lines 24 of FIG. 1 would preferably connect with individual crude oil feed inlets 54, for example utilizing suitable rigid or flexible lines. Alternately but less preferred, two or more individual well lines 24 might combine before feeding to crude oil feed inlets 54. Individual connection of well lines 24 with crude oil collection header apparatus 22 is preferred particularly to periodically at least partially determine flow rate from an individual well line 24 during production, as will be described subsequently.

Preferred embodiment collection header apparatus 22 has four banks or series 60, 61, 62, and 63 of a plurality of fluid conduits 28. More or fewer than the depicted four series might be provided. Further, the fluid conduits might not necessarily be organized into sets/series, although such is preferred. In the depicted exemplary embodiment, the plurality of fluid conduits 28 within individual of the series 60, 61, 62 and 63 joins with collection reservoir 26 along respective straight lines which are also depicted as being substantially vertical. Further preferably as shown, fluid conduits 28 are respectively substantially horizontally oriented.

Crude oil collection header apparatus 22 includes a flow meter conduit which is connected with multiple of the plurality of fluid conduits 28 downstream of the respective bypass valves 52, with two such flow meter conduits 66 and 67 being shown in one embodiment. In the depicted embodiment, connection of multiple fluid conduits 28 is accomplished at least in part by a suitable bypass conduit 68 which is associated with individual of the series 60, 61, 62, and 63, and to which fluid conduits 28 connect downstream of the respective bypass valves 52. In the depicted exemplary embodiment, each bypass conduit 68 extends along a straight line that is substantially parallel to the straight line along which fluid conduits 28 preferably join with collection reservoir 26, with such in the depicted embodiment being substantially vertically oriented. Bypass conduits 68 and the associated fluid conduits 28 and flow meter conduits 66, 67 are preferably supported by suitable leg assemblies 70 as shown.

Two circumferentially adjacent bypass conduits 68 of collection header apparatus 22 are shown as joining via suitable conduits and then feeding to one of flow meter conduits 66 or 67. Accordingly in the depicted preferred embodiments, and by way of example only, one of flow meter conduits 66 or 67 can be considered as a first flow meter conduit connecting with a bypass conduit of a first two of the four series of the plurality of fluid conduits 28 (i.e., flow meter conduit 66 with series 60 and 63). The other of flow meter conduits 66, 67 can be considered as a second flow meter conduit connecting with a bypass conduit 68 of a second two of the four series of the plurality of fluid conduits 28 (i.e., flow meter conduit 67 with series 61 and 62).

A suitable flow meter 72 operably connects with the respective flow meter conduits for determining/reporting fluid flow therethrough. Flow meter 72 might report flow in any of a combination of analog, digitally, on-site at header apparatus 22, and/or electronically or otherwise transmitted to a location remote from where header apparatus 22 is located. Preferably, the flow meter conduits and flow meter are oriented such that fluid flow therethrough will be upwardly (with vertically upward being shown), or alternately preferably horizontally therethrough.

Figure 3:
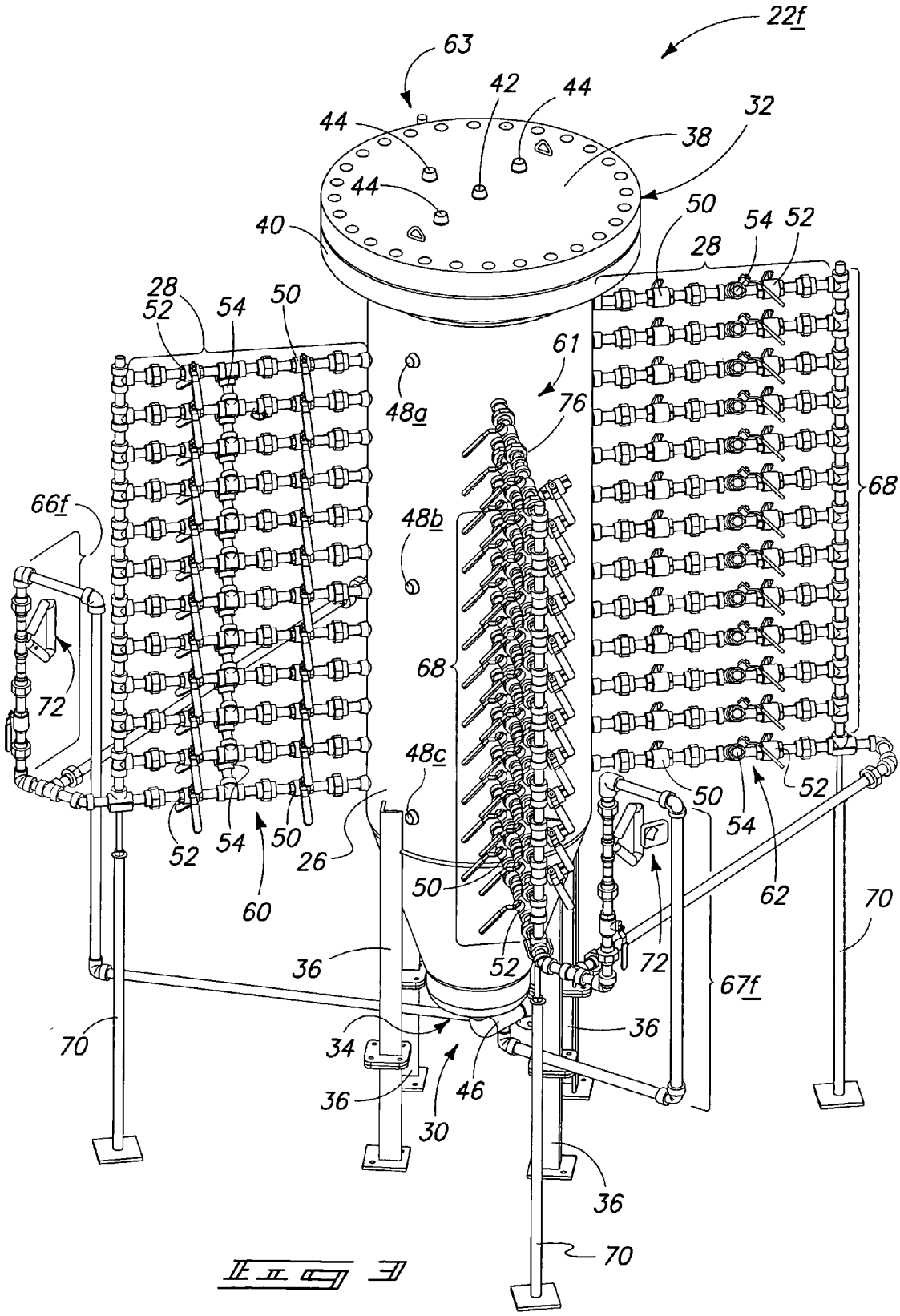
FIG. 3 is a perspective view of an alternate embodiment crude oil collection header apparatus in accordance with an aspect of the invention.

Flow meter conduits 66, 67 preferably connect with at least one of collection reservoir 26 or a suitable crude oil outlet conduit, for example connecting with or downstream of exemplary crude oil outlet conduit 46. FIG. 2 depicts the most preferred embodiment wherein flow meter conduits 66 and 67 connect with collection reservoir 26, for example via respective conduits 76 proximate upper end 32 of collection reservoir 26, and preferably for example in-line with where fluid conduits 28 within the depicted series 60 and 61 connect with reservoir 26. Alternately by way of example only, flow meter conduits 66 and 67 might connect elsewhere with collection reservoir 26. FIG. 3 by way of example only, depicts a less preferred embodiment crude oil collection header apparatus 22*f*. Like numerals from the first described embodiment are utilized where appropriate, with differences being indicated with a small letter "f" or with different numerals. FIG. 3 depicts flow meter conduits 66*f*, 67*f* connecting with crude oil outlet conduit 46*f*.

Flow meter conduits 66 and 67 are individually shown as connecting with multiple of a plurality of fluid conduits 28 downstream of the respective bypass valves 52. Preferably, the multiple is at least ten in number, more preferably at least twenty in number, and even more preferably at least twenty-five in number. The depicted exemplary embodiment depicts twenty-five fluid conduits 28 being connected with an individual flow meter 72. For example, each of series 63 and 62 are depicted as individually comprising thirteen fluid conduits 28 and each of series 60 and 61 is depicted as comprising twelve fluid conduits 28, which respectively combine to total twenty-five fluid conduits 28 respectively feeding an individual flow meter conduit 66 or 67. Of course, more or fewer fluid conduits might be associated with an individual flow meter conduit. Further and by way of example only, only a single flow meter conduit and a single flow meter might be utilized. For example, all the outlets of fluid conduits 28 downstream of the respective bypass valves 52 could ultimately connect with a single flow meter conduit within which a single flow meter is received.

One preferred method of operation of crude oil collection header apparatus 22 will now be described. However, the apparatus aspects of the invention are in no way limited by the preferred method of operation as described. In a normal production configuration, each of collection reservoir feed valves 50 might normally be opened and each of bypass valves 52 might normally be closed. Thereby, crude oil flowing through exemplary well lines 24 of FIG. 1 to crude oil feed inlets 54 flows to and collects within collection reservoir 26. Most preferably, such flow from lines 24 to apparatus 22 is primarily, if not entirely, by gravity. Further most preferably within apparatus reservoir 26, crude oil flow is preferably also at least primarily under gravity through crude oil outlet 30, and/or perhaps regulated therethrough via suitable valving and/or with a pump (not shown) associated with conduit 46. It is of course to be recognized that fluid flowing through lines 24 would likely comprise crude oil in combination with other liquids, gases, and/or solids, for example water, natural gas, and/or at least some degree of particulate. Flow rate from outlet 30 might be regulated by suitable valving to maintain fluid level within collection reservoir 26 somewhere between fluid level sensors 48*a* and 48*c*.

At some point, it might be desirable to determine once or multiple times the rate of flow of at least some of the fluid flowing through each of individual well lines 24 and/or at least through individual fluid conduits 28. In such instance with respect to a particular fluid conduit 28 to be analyzed, for example, its collection reservoir feed valve 50 would be closed and its bypass valve 52 opened. Thereby, fluid flow occurs through one of bypass headers 68 through the associated flow meter conduit 66 or 67 and past a flow meter 72 for monitoring/reporting flow within an individual fluid conduit 28. Such is then preferably returned to collection reservoir 26 in the FIG. 2 example. Accordingly, at least some of the flow rate within individual fluid conduits 28/through individual inlets 54 can be individually periodically monitored, and preferably without a flow meter being associated with each individual fluid conduit 28.

An aspect of the invention contemplates a method of collecting crude oil, and even/including perhaps independent of the above-described preferred embodiment collection header apparatus. Such a method contemplates positioning any suitable collection header apparatus within the earth elevationally lower than a crude oil-bearing strata, for example the diagrammatically depicted collection header apparatus 22 beneath an exemplary crude oil-bearing strata 12 in FIG. 1. The collection header apparatus will comprise some collection reservoir. Collection header apparatus 22/22*f* of FIGS. 2 and 3 by way of example only are but exemplary such collection header apparatus.

A plurality of well lines in fluid communication with the crude oil-bearing strata is connected to the collection header apparatus, for example well lines 24 as depicted in FIG. 1. Crude oil is flowed at least in part by gravity from crude oil-bearing strata 12 through the well lines to the collection reservoir of the collection header apparatus. Most preferably, such crude oil flow is primarily, if not entirely, by gravity. Further, such crude oil might be flowing in combination with other liquid, gas, and/or solid particulate, and might although less desirably be assisted in at least some way by a secondary and/or a tertiary recovery method (whether existing or yet-to-be developed) that is applied to exemplary crude oil-bearing strata 12. Regardless, crude oil ultimately is withdrawn from the collection reservoir. Crude oil flow within collection reservoir 26 is preferably primarily, if not entirely, by gravity. Again, such might and typically would be in combination with one or more other gas, liquids, and/or solid material, for example water and/or natural gas.

Periodically, at least some of such flowing crude oil in individual of the well lines is separately routed through a flow meter to monitor therefrom flow of crude oil in said individual well lines. Preferably, the separately routed crude oil in individual of the well lines is flowed to one of the collection reservoir or to a conduit downstream of the collection reservoir after flowing through the flow meter. Of course in the depicted exemplary FIGS. 2 and 3 embodiments, crude oil flow within a conduit 28 of banks 60 and 63 and fluid flow within a conduit 28 of banks 61 and 62 might be simultaneously monitored via their respective flow meters 72.

In one preferred implementation, withdrawing of crude oil from the collection reservoir occurs proximate a bottom end thereof. In one preferred embodiment, crude oil is flowed to the collection reservoir from a conduit which is substantially horizontally oriented where it joins with the collection reservoir. In one preferred embodiment, separately routing of the flowing crude oil in individual of the well lines comprises feeding the crude oil through said flow meter and then into the collection reservoir proximate an upper end thereof, and in one preferred embodiment from a conduit which is substantially horizontally oriented where it joins with the collection reservoir. In one preferred embodiment, the separately routing of the flowing crude oil in individual of the well lines comprises opening one valve and closing another valve.

By ways of example only, such methods of operation can be accomplished via operating the exemplary preferred crude oil collection header apparatus as described above in connection with FIGS. 2 and 3.

In compliance with the statute, the invention has been described in language more or less specific as to structural and methodical features. It is to be understood, however, that the invention is not limited to the specific features shown and described, since the means herein disclosed comprise preferred forms of putting the invention into effect. The invention is, therefore, claimed in any of its forms or modifications within the proper scope of the appended claims appropriately interpreted in accordance with the doctrine of equivalents.

The invention claimed is:

1. A crude oil collection header apparatus, comprising:

a collection reservoir;

a plurality of fluid conduits connected to feed crude oil to the collection reservoir; the fluid conduits respectively comprising a collection reservoir feed valve, a bypass valve, and a crude oil feed inlet, the crude oil feed inlet being received in the respective fluid conduits between the collection reservoir feed and bypass valves;

a flow meter conduit connected with multiple of the plurality of fluid conduits upstream of the respective collection reservoir feed valves and downstream of the respective bypass valves, a flow meter operably connected with the flow meter conduit; and a crude oil outlet associated with the collection reservoir.

2. The apparatus of claim 1 wherein the flow meter conduit is upstream of and connects with the collection reservoir.

3. The apparatus of claim 1 further comprising an outlet conduit connected with the crude oil outlet, the flow meter conduit being upstream of and connecting with the crude oil outlet conduit.

4. The apparatus of claim 1 further comprising a bypass conduit to which said multiple of the plurality of fluid conduits connect downstream of the respective bypass valves, the bypass conduit connecting with the flow meter conduit.

5. The apparatus of claim 1 wherein the plurality of fluid conduits join with the collection reservoir along a straight line.

6. The apparatus of claim 1 wherein the collection reservoir is elongated and substantially vertically oriented.

7. The apparatus of claim 6 wherein the fluid conduits are substantially horizontally oriented.

8. The apparatus of claim 6 wherein the plurality of fluid conduits join with the collection reservoir along a vertical line.

9. The apparatus of claim 6 wherein the collection reservoir comprises an upper end and a lower end, the crude oil outlet being proximate the lower end, the flow meter conduit connecting with the collection reservoir proximate the upper end.

10. The apparatus of claim 1 comprising a pressure relief valve associated with the collection reservoir.

11. The apparatus of claim 1 wherein the multiple is at least ten in number.

12. The apparatus of claim 1 wherein the multiple is at least twenty in number.

13. The apparatus of claim 1 wherein the flow meter conduit and flow meter are configured for fluid flow through the flow meter in at least one of an upward direction or a horizontal direction.

14. The apparatus of claim 13 wherein the flow meter conduit and the flow meter are configured for fluid flow through the flow meter in an upward direction.

15. The apparatus of claim 14 wherein the flow meter conduit and the flow meter are configured for fluid flow through the flow meter in a vertical direction.

16. A crude oil collection header apparatus, comprising:

a collection reservoir;

a plurality of fluid conduits connected to feed crude oil to the collection reservoir; the fluid conduits joining with the collection reservoir along a straight line; the fluid conduits respectively comprising a collection reservoir feed valve, a bypass valve, and a crude oil feed inlet, the crude oil feed inlet being received in the respective fluid conduits between the collection reservoir feed and bypass valves;

a bypass conduit to which the fluid conduits connect upstream of the respective collection reservoir feed valves and downstream of the respective bypass valves, the bypass conduit extending along a straight line that is substantially parallel to the straight line along which the fluid conduits join with the collection reservoir;

a flow meter conduit connected with the collection reservoir and the bypass conduit, a flow meter operably connected with the flow meter conduit between the collection reservoir and the bypass conduit; and a crude oil outlet associated with the collection reservoir.

17. The method of claim 16 wherein the fluid conduits are substantially horizontally oriented.

18. The apparatus of claim 16 wherein the straight lines are vertical.

19. The apparatus of claim 18 wherein the fluid conduits are substantially horizontally oriented.

20. The apparatus of claim 16 wherein the collection reservoir is elongated and substantially vertically oriented.

21. The apparatus of claim 16 wherein the flow meter conduit and flow meter are configured for fluid flow through the flow meter in at least one of an upward direction or a horizontal direction.

22. A crude oil collection header apparatus, comprising:

an elongated and substantially vertically oriented collection reservoir having an upper end and a lower end;

at least four series of a plurality of fluid conduits connected to feed crude oil to the collection reservoir; the plurality of fluid conduits within individual of the series being substantially horizontally oriented and joining with the collection reservoir along a vertical line; the fluid conduits respectively comprising a collection reservoir feed valve, a bypass valve, and a crude oil feed inlet, the crude oil feed inlet being received in the respective fluid conduits between the collection reservoir feed and bypass valves;

a bypass conduit associated with individual of the series and to which the fluid conduits connect downstream of the respective bypass valves, the bypass conduit being substantially vertically oriented;

first and second flow meter conduits, the first flow meter conduit being connected with the collection reservoir proximate its upper end and with the bypass conduits of a first two of the at least four series of the plurality of fluid conduits, the second flow meter conduit being connected with the collection reservoir proximate its upper end and with the bypass conduits of a second two of the at least four series of the plurality of fluid conduits, a flow meter operably connected with each of the first and second flow meter conduits between the collection reservoir and the respective bypass conduit; and a crude oil outlet proximate the lower end of the collection reservoir.

23. The apparatus of claim 22 wherein the collection reservoir comprises a plurality of fluid level sensors.

24. The apparatus of claim 22 wherein the collection reservoir comprises a pressure relief valve proximate the upper end.

25. The apparatus of claim 22 wherein the plurality within individual of the series is at least ten.

26. The apparatus of claim 22 wherein the plurality within individual of the series is at least twenty.

27. A method of collecting crude oil, comprising:

positioning a collection header apparatus within the earth lower than a crude oil-bearing strata, the collection header apparatus comprising a collection reservoir;

connecting a plurality of well lines in fluid communication with the crude oil-bearing strata to the collection header apparatus;

flowing crude oil at least in part by gravity from the crude oil-bearing strata through the well lines to the collection reservoir of the collection header apparatus;

withdrawing crude oil from the collection reservoir; and periodically separately routing at least some of said flowing crude oil in individual of the well lines through a flow meter to monitor therefrom flow of crude oil in said individual well lines.

28. The method of claim 27 wherein at least some of the separately routed flowing crude oil in the individual of the well lines is flowed to the collection reservoir after flowing through the flow meter.

29. The method of claim 27 wherein at least some of the separately routed flowing crude oil in the individual of the well lines is flowed to a conduit downstream of the collection reservoir after flowing through the flow meter.

30. The method of claim 27 wherein the collection reservoir is elongated and oriented in a substantially vertically upright orientation.

31. The method of claim 30 comprising withdrawing crude oil from the collection reservoir proximate a bottom end of the collection reservoir.

32. The method of claim 30 comprising flowing crude oil to the collection reservoir from a conduit which is substantially horizontally oriented where it joins with the collection reservoir.

33. The method of claim 30 wherein the separately routing comprises feeding the crude oil flowing through said flow meter into the collection reservoir proximate an upper end thereof.

34. The method of claim 33 wherein the crude oil flowing from the flow meter flows to the collection reservoir from a conduit which is substantially horizontally oriented where it joins with the collection reservoir.

35. The method of claim 27 wherein the separately routing comprises opening one valve and closing another valve.

* * * * *